United States Patent [19]

Ishizuki

[11] 4,227,698

[45] Oct. 14, 1980

[54] TABLE GAME

[75] Inventor: Saburo Ishizuki, Tokyo, Japan

[73] Assignee: Kabushikikaisha Anoa, Tokyo, Japan

[21] Appl. No.: 20,548

[22] Filed: Mar. 14, 1979

Related U.S. Application Data

[63] Continuation of Ser. No. 784,520, Apr. 4, 1977, abandoned.

[51] Int. Cl.[3] ..... A63F 1/00; A63F 1/10

[52] U.S. Cl. ..... 273/309; 273/150; 273/303

[58] Field of Search ..... 273/148 R, 148 A, 150, 273/292, 293, 303, 309

[56] References Cited

U.S. PATENT DOCUMENTS

| | | | |
|---|---|---|---|
| 550,584 | 12/1895 | Bristow | 273/295 |
| 962,162 | 6/1910 | McDonald | 273/148 R |
| 1,581,859 | 4/1926 | New | 273/306 |
| 1,632,941 | 6/1927 | Abell | 273/303 |
| 1,678,375 | 7/1928 | Bersenbrugge | 273/148 R |
| 1,686,237 | 10/1928 | Hoexter | 35/35 J X |
| 2,818,261 | 12/1957 | Morgan | 273/150 |

FOREIGN PATENT DOCUMENTS

| | | | |
|---|---|---|---|
| 212223 | 5/1924 | United Kingdom | 273/150 |
| 398674 | 9/1933 | United Kingdom | 273/293 |

OTHER PUBLICATIONS

"The Mah-Jung Manual" by Henry M. Snyder, copyrighted, 1923, pp. 7-13.

*Primary Examiner*—Anton O. Oechsle
*Attorney, Agent, or Firm*—Hill, Van Santen, Steadman, Chiara & Simpson

[57] ABSTRACT

This game for children is played using a plurality of like-shaped playing pieces or tiles divided into sets having an equal number of pieces per set. Each piece of a set has a particular design in a particular color on one exposed surface of a piece. The other exposed surfaces of each piece are unmarked. The design and color utilized have been selected to be easily recognized by a young child and distinguishable from the other designs and colors used. A fixed number of pieces are selected randomly by players of the game to form a hand leaving a set number of remaining undivided pieces. Each selected piece can be conveniently placed in a support rack carried by a four-sided frame of a playing board. Each player in rotation then selects a piece from the undivided remaining pieces. The player retains the selected piece if the design or color of the design matches that of a piece in the hand. If the design or color of the design does not match, the player discards that piece or another piece such that the number of pieces in the hand remains the same. The first player to obtain sets of matching pieces is a winner.

2 Claims, 7 Drawing Figures

TABLE GAME

This is a continuation of application Ser. No. 784,520, filed Apr. 4, 1977, now abandoned.

BACKGROUND OF THE INVENTION

1. Field of the Invention

This invention relates to a table game which is particularly suited for younger children.

2. Description of the Prior Art

Table games for adults have been in existence for many years and in many forms and include such well-known noncard games as backgammon, chess, checkers, chinese checkers and Mah-Jongg, to name but a few.

Most such games are not enjoyed by most younger children because of the complicated rules and complex strategy required to play such with some degree of proficiency.

SUMMARY OF THE INVENTION

This invention relates to a table game such as Mah-Jongg and can be played by two to four players positioned around a table.

The format, procedures and rules of the game are purposely designed to interest and be playable and enjoyed by younger children while at the same time can perform a teaching function to help the child player learn, as an example, to recognize his or her colors, numbers, symbols, abbreviations, letters of the alphabet, physical objects or other educational related information.

With two to four players seated about a typical card table, each player alternatively selects a tile or playing piece from a quantity of tiles placed face down in the middle of the table.

The face of each tile contains a design in a particular color such that there are, as an example, three sets of designs and three sets of colors utilized. As noted above, the number of different sets of designs and sets of colors utilized can be widely varied. Regardless of the designs or colors utilized, the selection is made so that a younger child can recognize or learn to recognize them.

The face-down tiles can conveniently be placed within a rectangular board enclosed by a frame comprising four joined legs on which a tile support rack may be slidably carried. As a tile is selected by a player, the selected tile can be placed in the rack with the face of the tile containing the design facing that player. Upon selection of a fixed number of tiles by each player, play begins.

Play comprises each player in turn selecting a tile from the unselected tiles in the center of the table, trying to match the design or color of one of the tiles already pre-selected and then discarding either the selected tile or keeping the selected tile and discarding another tile as the case may be. The first player to obtain sets of matching tiles wins.

If the game is to comprise a series of matches, each player is supplied a quantity of chips having a particular value. The losing players of a match must give the winning player chips equal to the number of unmatched tiles in that player's hand. When one player gains sufficient chips to equal or exceed a particular value, that player wins the game.

DETAILED DESCRIPTION OF THE PREFERRED EMBODIMENT

A playing board 1 for playing the game of this invention comprises a flat playing surface 2 surrounded by a raised frame 3 which includes frame members 3*a, b, c* and *d*.

Figure 6:
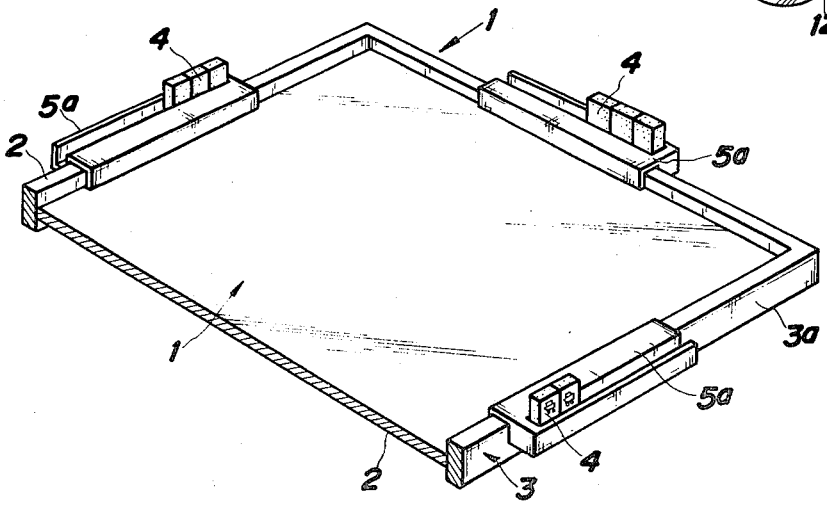
FIG. 6 is a perspective view in particular section of the playing board of FIG. 1 with racks of FIG. 5A supported on the framed sides of the playing board.

As best seen in FIG. 6, the raised frame members 3*a*–3*d* are of sufficient height to carry a support rack 5*a* having an inverted U-shaped portion 20 to slidably engage a top of each frame member 3*a*–3*d* respectively and adjoining U-shaped portion 22 in which tiles 4 can be positioned.

Figure 5:
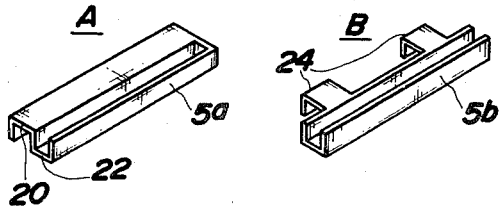
FIGS. 5A and B is a perspective view of a respective rack for supporting a set of tiles of a player.

In FIG. 5B is an alternate configuration of the support rack 5*b* wherein two inverted U-shaped clips 24 are used to slidably carry the rack 5*b* on a frame member.

Figure 1:
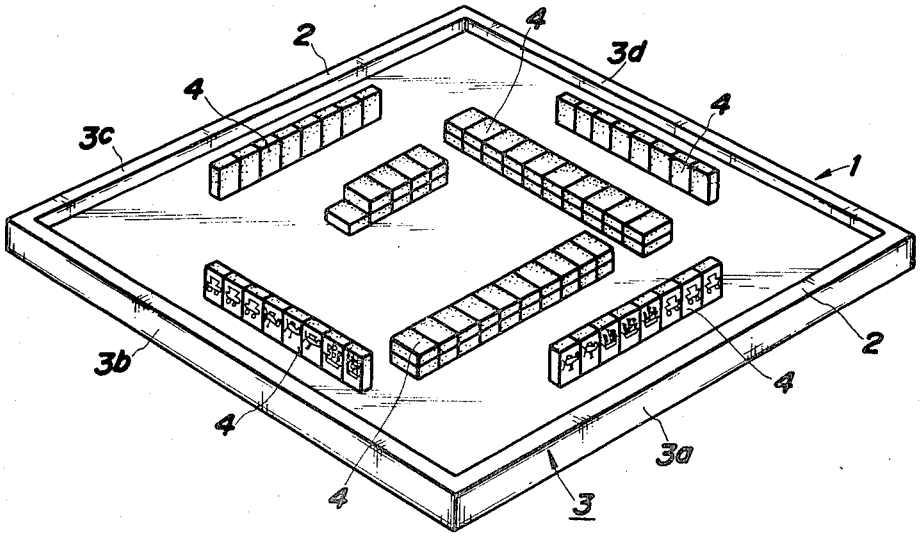
FIG. 1 is a perspective view showing tiles or playing pieces placed on a playing board comprising a surface and framed sides.
Figure 2:
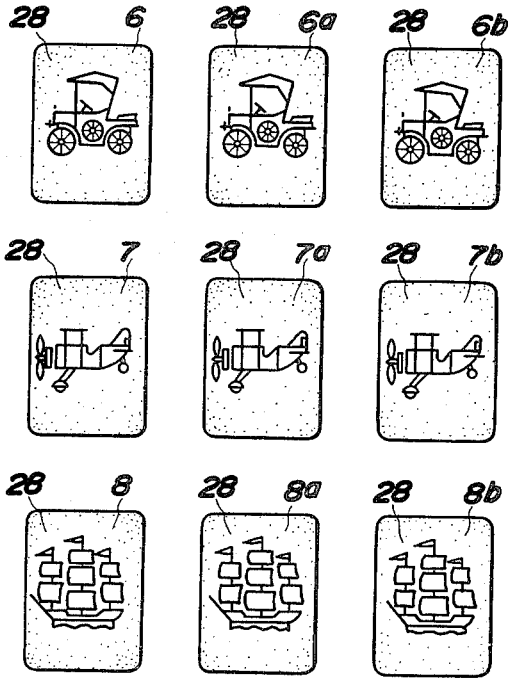
FIG. 2 is a front view of typical tiles having a particular design on one face thereof.
Figure 3:
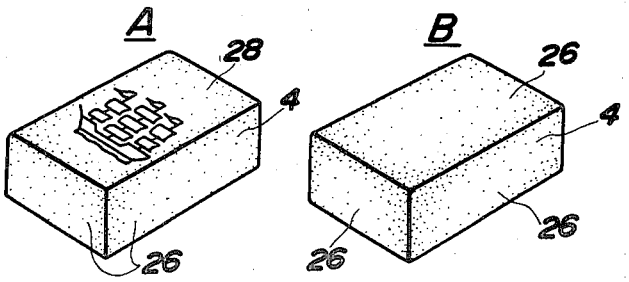
FIGS. 3A and B is a perspective view of one tile of FIG. 2 with FIG. 3A showing a tile face up and FIG. 3B showing a tile face down.

The game comprises a plurality of tiles 4, in the case of this embodiment 81, which have a box-like configuration as best seen in FIG. 3A and FIG. 3B having five plain surfaces 26 and a face 28 containing a design. As best seen in FIG. 2 are examples of an antique automobile design 6, an airplane design 7 and a sailing ship design 8. The object depicted by a particular design has been chosen to be easily recognizable by a young child. The designs 6, 7 and 8 are provided in a particular color, as an example black. Designs 6*a*, 7*a* and 8*a* are provided in a different color, as an example blue, and designs 6*b*, 7*b* and 8*b* are provided in a third color, as an example red.

It should be understood that the design chosen can include more complex objects, similar designs having subtle differences, letters of the alphabet and numbers so that a young child player will be motivated to increase his or her skill in the use of such symbols and perfect the ability of distinguishing differences and recognizing similarities.

In a specific example of the game, 81 playing tiles divided into nine tiles each comprising a first set having a land transportation means indicia in a first color on one exposed face of each of nine tiles in said set, a second set having said land transportation means indicia of a second color on one exposed face of each of nine tiles in said second set, a third set having said land transportation means indicia of a third color on one exposed face of each of nine tiles of said set, a fourth set having an air transportation means indicia of said first color on one exposed face of each of nine tiles of said fourth set, a fifth set having said air transportation means indicia in said second color on one exposed face of each of nine tiles of said fifth set, a sixth set having said air transportation indicia in said third color on one exposed face of each of nine tiles of said sixth set, a seventh set having a water transportation means indicia of said first color on one exposed face of each of nine tiles of said seventh set, an eighth set having said water transportation means indicia of said second color on one exposed face of each of nine tiles in said eighth set, and a ninth set having said water transportation means indicia of said third color on one exposed face of each of nine tiles of said ninth set were used.

Figure 7:
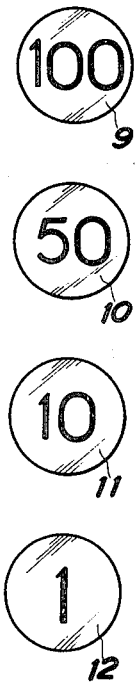
FIG. 7 is a figure of counting chips used in this game.

A set of counting chips as shown in FIG. 7 can be provided to further assist in the educational process of the players and, as shown, includes a hundred point chip 9, a fifty point chip 10, a ten point chip 11 and a one point chip 12. By using such chips, the game can be extended to include a series of rounds or matches before the game is completed.

The game can be played by two to four players who are positioned about the playing board 1 such that each player is positioned opposite a particular frame member 3*a*–3*d*. In this manner, each player may have his or her support rack 5*a* or 5*b* to fit over the top of the opposite frame member 3*a*–3*d*, respectively.

The plurality of tiles 4 (in this case 81 tiles) are placed on the playing surface 2 of the playing board within the enclosing frame member 3*a*–3*d* so that the face 28 containing a particular design is face down and therefore remains hidden.

If the counting chips 9–12 are to be used, these chips 9–12 are divided equally between the players so that each player starts the game with chips, the sum of which is equal in value.

Each player in turn selects a tile 4 from the plurality of tiles on the playing board 1 and places that tile in the tile support rack 5*a* such that the face 28 of the tile 4 containing a design cannot be seen by the other players. Selection of tiles is completed when each player has nine tiles 4 leaving 45 unselected tiles if there are four players.

The first player to select a tile is rotated among the players so that each player has an opportunity to select first.

The first player to have three sets of three matching tiles wins the game or match, if the counting chips 9–12 are utilized.

To obtain matching sets, the player who first selected a tile to obtain the original set of nine tiles, selects from the unselected tiles which remain in the middle of the playing board 1.

As matching may be obtained by either color or design, upon selection that player compares the selected tile with the tiles in his or her hand. If his or her hand contains a like color or like design, the selected tile is retained and a nonmatched tile discarded by placing it on the playing surface 2 so that the face 28 remains hidden. If the design of the selected tile 4 fails to match the design of any other tile in the hand, the player has the option of discarding the selected tile 4 or keeping the selected tile 4 and discarding another unmatched tile 4.

Selection and discarding of tiles 4 is performed in turn by the players until one player obtains three sets of three matching tiles 4, as an example, three sets of three tiles of one design and in one color, as an example, three tiles with the airplane design in red, three tiles with the automobile design in blue, and three tiles with the boat design in black.

When counting chips 9–12 are to be used, each player must give a certain number of chips 9–12 to the first player to win that round. The sum of the value of the chips, as an example, can equal the number of unmatched tiles in the hand of that player. The first player to obtain counting chips having a value which is equal to or exceeds a particular value wins the game.

An alternate procedure to utilize the elements of this invention in a game for more mature children is as follows.

First, this game may be played by two, three or four players with each player taking a seat at random around the playing board 1 on which the eighty-one tiles 4 should be well mixed and placed face down.

Each player then arranges the tiles 4 in two rows, placing one row on top of the other with the face of each tile down. The tiles 4 in each row may vary in number but should be the same for each player. Any unselected tiles 4 should be placed face down in the center of the playing surface 1.

The player to begin may be determined by casting dice, as an example. Play begins by the player to begin selecting eight tiles from the rows of tiles in front of that player and placing the selected tiles in a rack, as an example, the rack 5*a* in front of that player. Proceeding clockwise, the other players then select in turn eight tiles 4 placing the selected tiles in their respective racks. Care should be taken to prevent any other player from seeing the selected tiles 4.

The same number and value of counting chips 9, 10, 11 and 12 is given to each player.

The player to begin picks up a tile which is in the center of the row in front of him, and attempts to match that tile with other tiles in his hand. If that tile matches, another unmatched tile in the hand is discarded. If the picked up tile does not match, then the picked up tile or another unmatched tile is discarded. All discarded tiles are placed face up on the playing surface.

The next players select, in turn, the tile in the row next to the previously selected tile, proceeds with the matching process and discards an unmatched tile face up.

Play continues successively until one of the players has three sets of three tiles 4 of a kind in design and/or color without discarding a tile 4. That round is then over with the player first obtaining three sets of three matching tiles declared the winner.

The winner of a round earns a certain point value depending on a predetermined value assigned to a particular combination of designs and colors.

The losing players must give the winner the counting chips 9, 10, 11 and 12 which equal that amount to the points which the winner obtained.

After a series of rounds, the points that each winner of a round has obtained, are totaled and the player who has obtained the most points becomes the winner in the game.

The values assigned are as follows:

(1) each of the three sets vary in color and design, i.e. three tiles having a first design but in differing colors, or three tiles having the same color but in differing designs;

(2) each of the three sets is different in color or design, i.e. three tiles having a first color, three tiles having a first design and three tiles having a second color;

(3) each of the three sets is the same in color or design, i.e. three tiles having a first color and a first design, three tiles having a first color and a second design and three tiles having a first color and a third design;

(4) two of three sets are the same in color and design and one of three sets is varying in color and design, i.e. six tiles having a first design in a first color and three tiles in a second color having varying designs;

(5) all of three sets are the same in color and two of them are the same in design, i.e. nine tiles of the same color with six having the same design;

(6) all of three sets are the same in design and two of them are the same color, i.e. nine tiles of the same design with six having the same color;

(7) all of three sets are the same in color and design.

Figure 4:
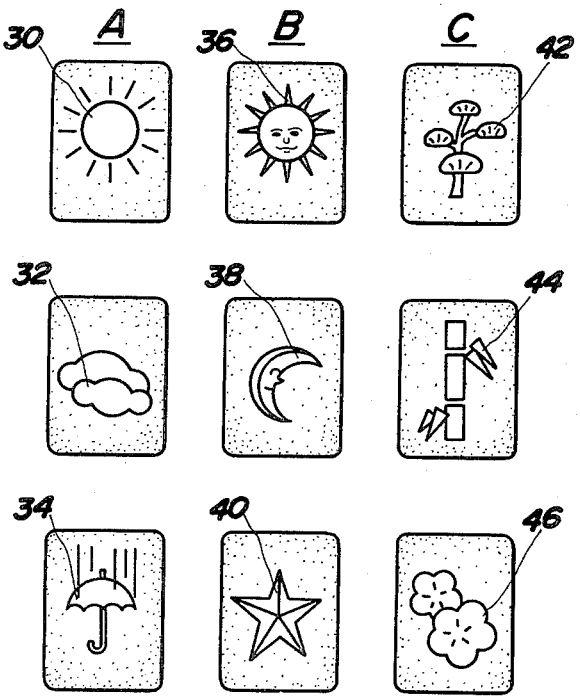
FIGS. 4A, B and C is a front view of the other tiles which can be used in the game.

As seen in FIG. 4, additional designs can be utilized and as shown is a sunny day design 30, a cloudy day design 32, a rainy day design 34, a sun design 36, a moon design 38, a star design 40, a pine tree design 42, a bamboo tree design 44 and a flower design 46.

While various modifications may be suggested by those versed in the art, it should be understood that I wish to embody within the scope of the patent warranted hereon, all such modifications as reasonably and properly come within the scope of my contribution to the art.

I claim as my invention:

1. A game for children comprising, (a) a playing board including an inner flat horizontal playing surface and a perimeter frame joining said surface to form a partial closure about said surface, (b) tile holding means having an inverted U-shaped portion for slidably engaging said perimeter frame and supported thereby and an elongated U-shaped portion joining said inverted portion to provide a holding space for tiles, and (c) a plurality of playing tiles, said plurality equaling 81 tiles divided into nine tiles each, and further comprising, a first set having a land transportation means indicia in a first color on one exposed face of each of nine tiles in said set, a second set having said land transportation means indicia of a second color on one exposed face of each of nine tiles in said second set, a third set having said land transportation means indicia of a third color on one exposed face of each of nine tiles of said set, a fourth set having an air transportation means indicia of said first color on one exposed face of each of nine tiles of said fourth set, a fifth set having said air transportation means indicia in said second color on one exposed face of each of nine tiles of said fifth set, a sixth set having said air transportation indicia in said third color on one exposed face of each of nine tiles of said sixth set, a seventh set having a water transportation means indicia of said first color on one exposed face of each of nine tiles of said seventh set, an eighth set having said water transportation means indicia of said second color on one exposed face of each of nine tiles in said eighth set, and a ninth set having said water transportation means indicia of said third color on one exposed face of each of nine tiles of said ninth set.

2. A game to be played by children comprising, a plurality of playing tiles having one face having indicia and remaining outside surfaces without indicia, said indicia selected from a group comprising alphabet letters, numerical digits, designs and/or colors recognizable by said children and carried by said tiles in sets, said sets having a selected number of tiles per set, wherein each child player selects in turn from said plurality of tiles to form a hand having a fixed number of tiles such that a quantity of tiles remain unselected, each player in turn then selecting a tile from said unselected quantity of tiles, matching said selected tile with said tiles previously selected and discarding an unmatched tile until said hand contains matching sets, which includes a playing board means on which to play said game having a flat horizontal inner playing surface and a continuous frame rail surrounding a perimeter of said surface and joined thereto, said frame rail having a top edge above said surface, a plurality of tile holding racks for holding said tiles slidably and removably mounted on said rail frame, said plurality equalling the number of said children playing said game, each of said racks having an inverted U-shaped portion slidably positioned over said frame rail and carried thereby and having an elongated U-shaped portion to support said fixed number of said tiles selected by said player to form his hand, said elongated portion being integrally connected to said inverted U-shaped portion.

* * * * *